US009151302B2

(12) United States Patent
Peng et al.

(10) Patent No.: US 9,151,302 B2
(45) Date of Patent: Oct. 6, 2015

(54) ROTATING AIR CYLINDER

(75) Inventors: Xue-Fei Peng, Shenzhen (CN); Huan-Fan Xu, Shenzhen (CN)

(73) Assignee: JI ZHUN PRECISION INDUSTRY (HUI ZHOU) CO., LTD., Huizhou (CN)

( * ) Notice: Subject to any disclaimer, the term of this patent is extended or adjusted under 35 U.S.C. 154(b) by 884 days.

(21) Appl. No.: 13/327,716

(22) Filed: Dec. 15, 2011

(65) Prior Publication Data

US 2013/0000479 A1 Jan. 3, 2013

(30) Foreign Application Priority Data

Jun. 29, 2011 (CN) ..... 2011 1 0178985

(51) Int. Cl.
*F15B 15/08* (2006.01)
*F15B 15/14* (2006.01)
*F15B 15/06* (2006.01)

(52) U.S. Cl.
CPC ..... *F15B 15/08* (2013.01); *F15B 15/068* (2013.01); *F15B 15/1414* (2013.01)

(58) Field of Classification Search
CPC .... F01B 3/0079; F15B 15/063; F15B 15/068; F15B 15/1414; F15B 15/1471; F15B 15/148
USPC ..... 92/2, 31, 136, 116; 173/104, 109, 110, 173/111; 269/20, 24, 27, 28, 32, 228
See application file for complete search history.

(56) References Cited

U.S. PATENT DOCUMENTS

| | | | | | |
|---|---|---|---|---|---|
| 2,955,579 | A * | 10/1960 | Block | 92/33 |
| 3,165,982 | A * | 1/1965 | Taylor | 92/33 |
| 5,108,079 | A * | 4/1992 | Yonezawa et al. | 269/24 |
| 6,736,384 | B2 * | 5/2004 | Yokota | 269/32 |
| 7,357,065 | B2 * | 4/2008 | Mitsui | 92/2 |
| 7,370,856 | B2 * | 5/2008 | Sawdon et al. | 269/49 |
| 7,618,030 | B2 * | 11/2009 | Yonezawa et al. | 269/24 |
| 8,292,280 | B2 * | 10/2012 | Yokota et al. | 269/254 R |

FOREIGN PATENT DOCUMENTS

CN 202091285 U 12/2011

* cited by examiner

*Primary Examiner* — Edward Look
*Assistant Examiner* — Michael Quandt
(74) *Attorney, Agent, or Firm* — Novak Druce Connolly Bove + Quigg LLP

(57) ABSTRACT

A rotating air cylinder is disclosed. The rotating air cylinder, comprises a first master cylinder comprising a first cylinder block, a first sealing assembly assembled in one distal end of the first cylinder block; a cylinder shaft partially received in the first cylinder block; a first piston assembly movably sleeving on the cylinder shaft, wherein the first piston assembly moves longitudinally within the first cylinder block, and rotates relative to the cylinder shaft; a second master cylinder positioned coaxial with the first master cylinder comprising a second cylinder block received in another part of the cylinder shaft; a second sealing assembly assembled in the second cylinder block; a second piston assembly received in the second cylinder block, non-rotatably and slidably connected with the cylinder shaft, wherein the second piston assembly moves longitudinally in the second cylinder block and rotates relative to an axis of the second cylinder block.

7 Claims, 5 Drawing Sheets

ROTATING AIR CYLINDER

BACKGROUND

1. Technical Field

The present disclosure relates generally to cylinders, and more particularly, to rotating air cylinders.

2. Description of Related Art

Many rotating air cylinders have single master cylinders. The master cylinder may include a cylinder block defining a receiving chamber, a piston and a cylinder shaft. The cylinder block may define openings at opposite ends communicating with the receiving chamber. The piston may be movably received in the receiving chamber, a first end of the cylinder shaft may be fixed to the piston, and a second end of the cylinder shaft may extend out of the cylinder body via one opening. A pressing rod is positioned in the second end of the cylinder shaft to clamp or transfer materials. The pressing rod is driven to rotate and move linearly at the same time. The rotating radius and the linear movement distance of the pressing rod is long. The volume of the cylinder may be relatively large, and a significant amount of space may be needed to enable the cylinder to work.

Therefore, there is room for improvement within the art.

BRIEF DESCRIPTION OF THE DRAWINGS

The elements in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
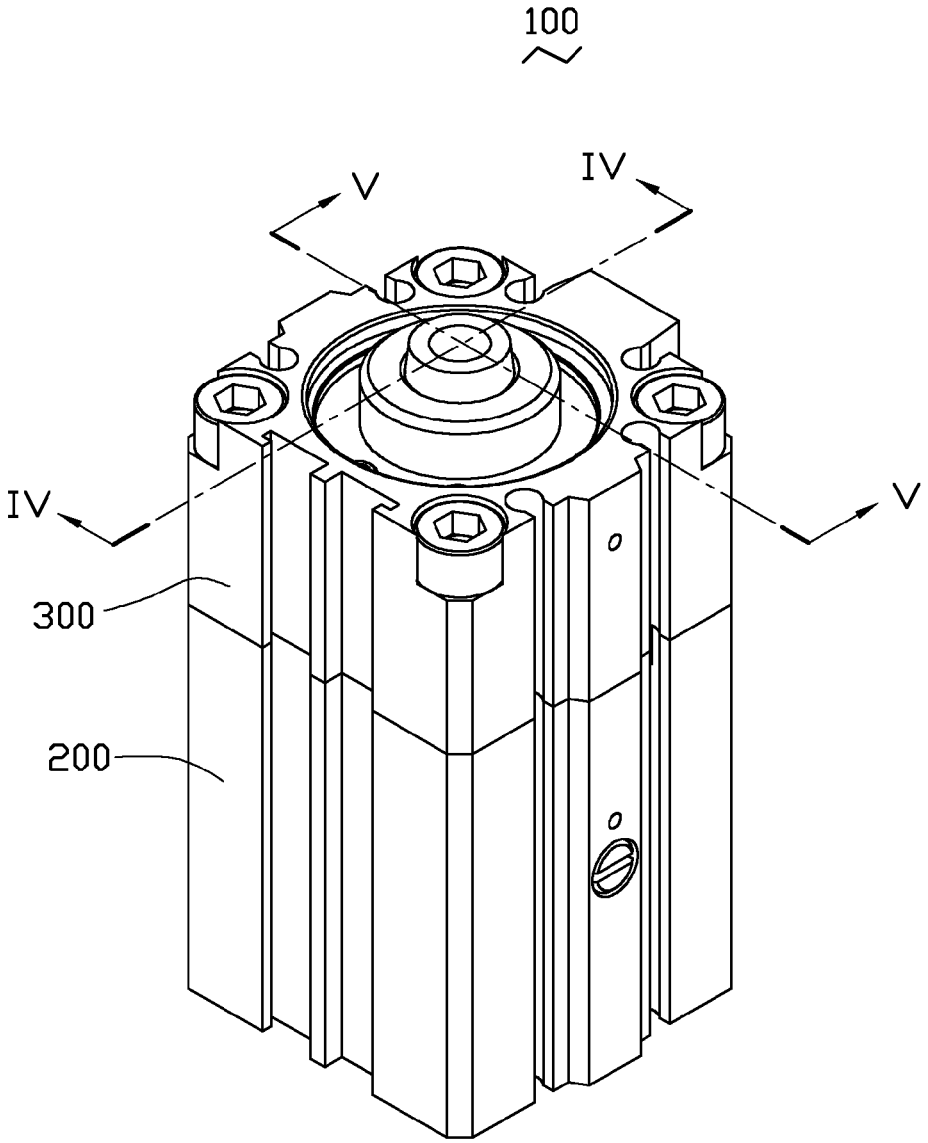
FIG. 1 is an isometric view of an embodiment of a rotating air cylinder.

Referring to FIG. 1, an embodiment of a rotating air cylinder 100 is a dual master cylinder, comprising a first cylinder mechanism 200 and a second cylinder mechanism 300 connecting with the first cylinder mechanism 200. The first and second cylinder mechanisms 200, 300 are coaxial.

Figure 2:
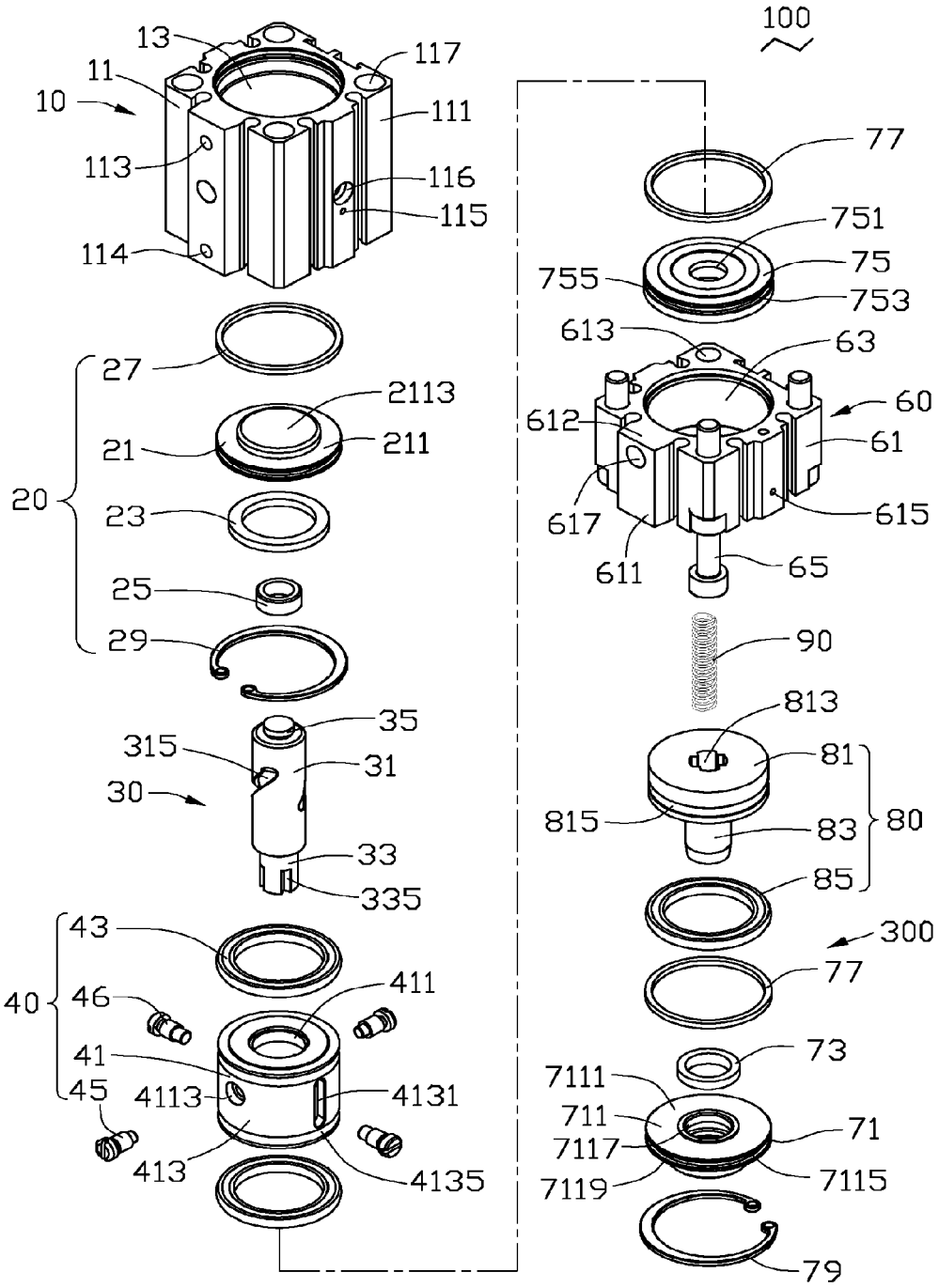
FIG. 2 is an exploded, isometric view of the rotating air cylinder of FIG. 1
Figure 3:
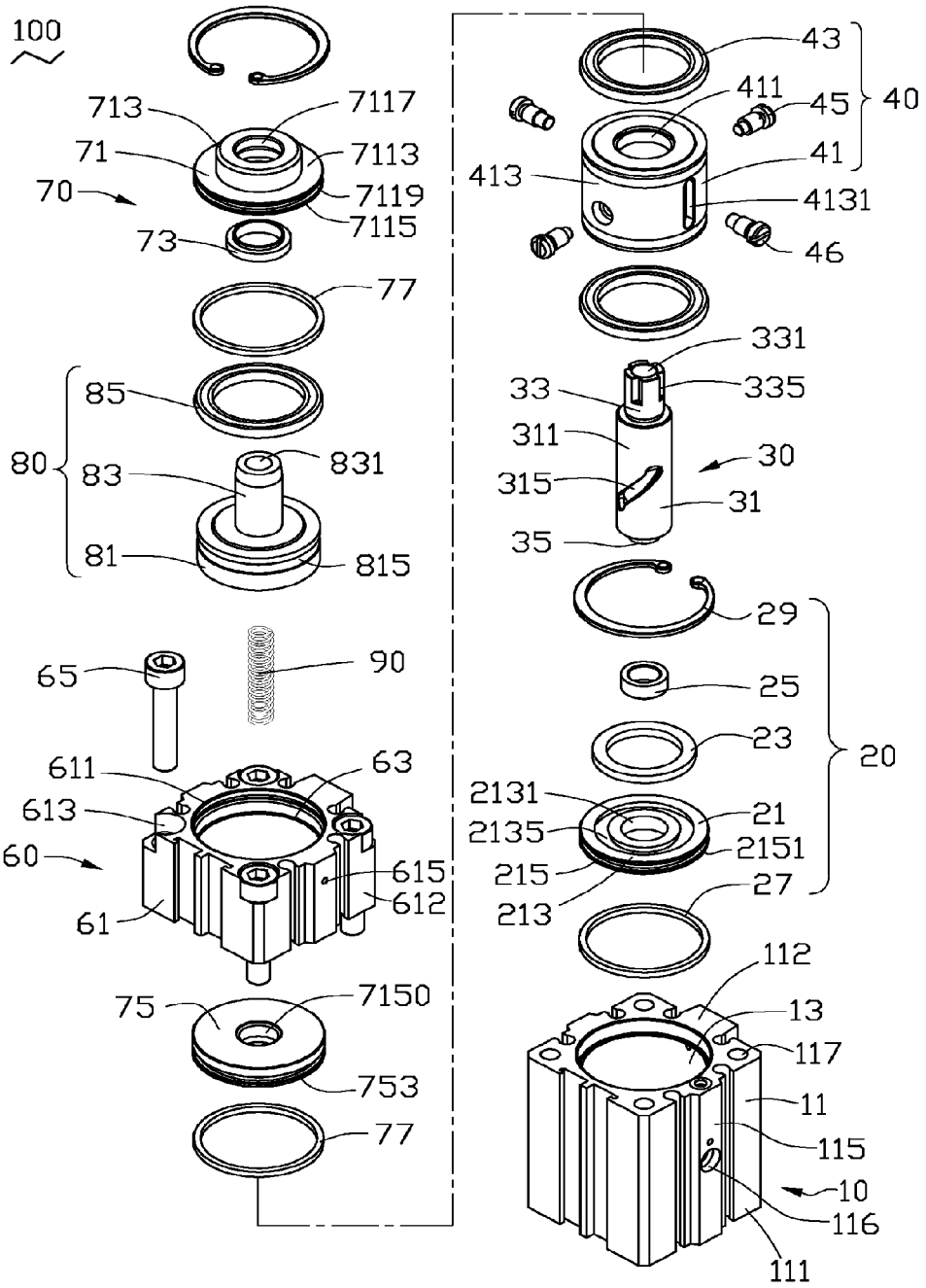
FIG. 3 is similar to FIG. 2, but viewed from another aspect.
Figure 4:
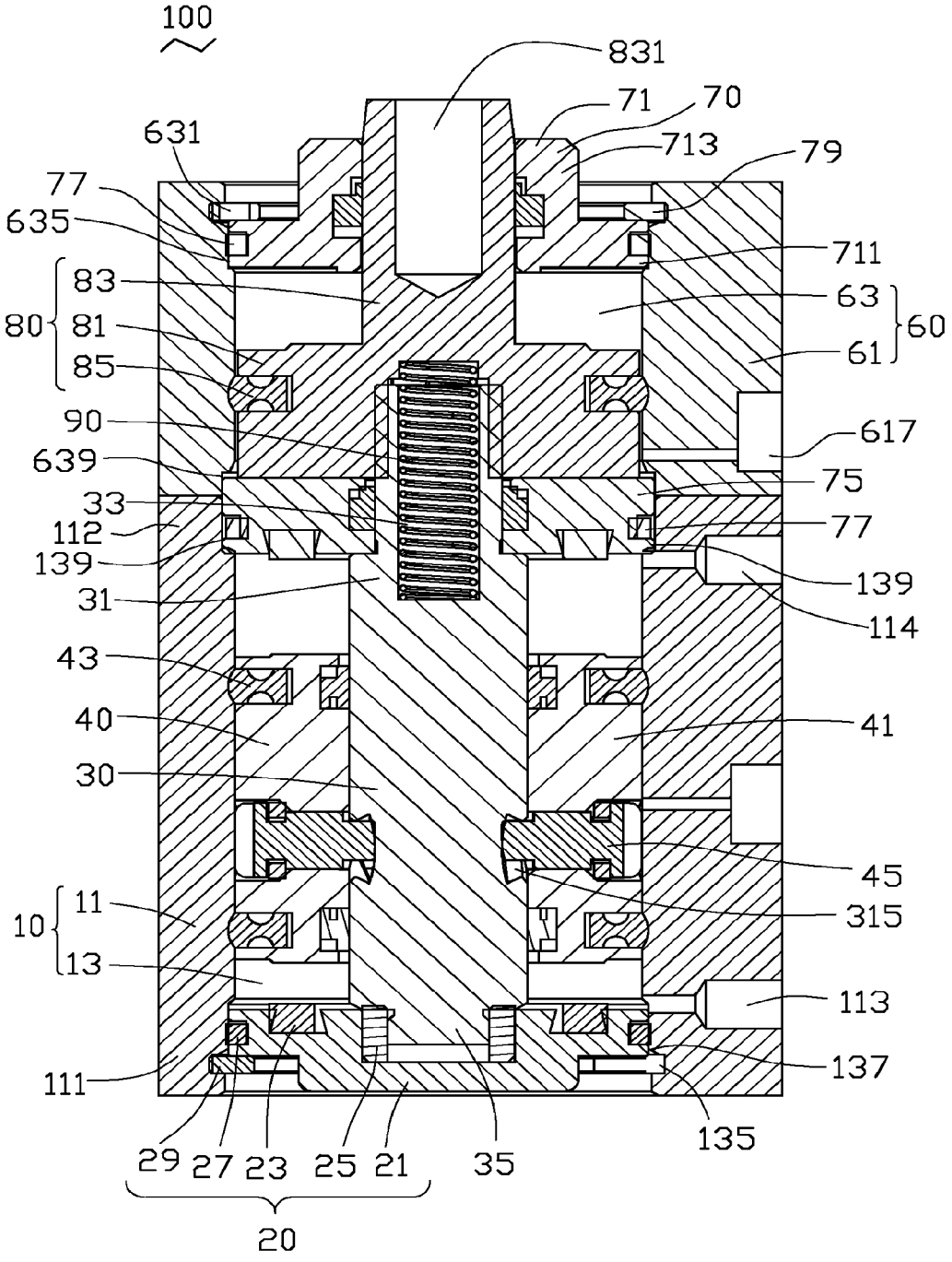
FIG. 4 is a cross section of the rotating air cylinder of FIG. 1, taken along line IV-IV.

Referring also to FIGS. 2 through 4, the first cylinder mechanism 200 comprises a first cylinder block 10, a first sealing assembly 20, a cylinder shaft 30, and a first piston assembly 40. In the first cylinder block 10, the first cylinder mechanism 200 comes between the first sealing assembly 20 and the second cylinder mechanism 300. The cylinder shaft 30 is partially received in the first cylinder block 10. The end of the cylinder shaft 30 extends through the first sealing assembly 20. The other end of the cylinder shaft 30 is, with other elements, assembled within the second cylinder mechanism 300. The first piston assembly 40 movably sleeves on the cylinder shaft 30. The first piston assembly 40 may move longitudinally within the first cylinder block 10, and rotate relative to the cylinder shaft 30.

The second cylinder mechanism 300 comprises a second cylinder block 60, a second sealing assembly 70, a second piston assembly 80, and an elastic member 90. The second cylinder block 60 is coaxially assembled with the first cylinder block 10. The second sealing assembly 70 is positioned in the second cylinder block 60 for hermetically isolating the second cylinder block 60 from the first cylinder block 10. The second piston assembly 80 is movably received in the second cylinder block 60. One distal end of the second piston assembly 80 is non-rotatably connected to the cylinder shaft 30. Another distal end of the second piston assembly 80 hermetically passes through the second sealing assembly 70 and extends from the second cylinder block 60. The second piston assembly 80 may move longitudinally in the second cylinder block 60 and rotate relative to the axis of the second cylinder block 60. The elastic member 90 is elastically resisted between the cylinder shaft 30 and the second piston assembly 80.

Figure 5:
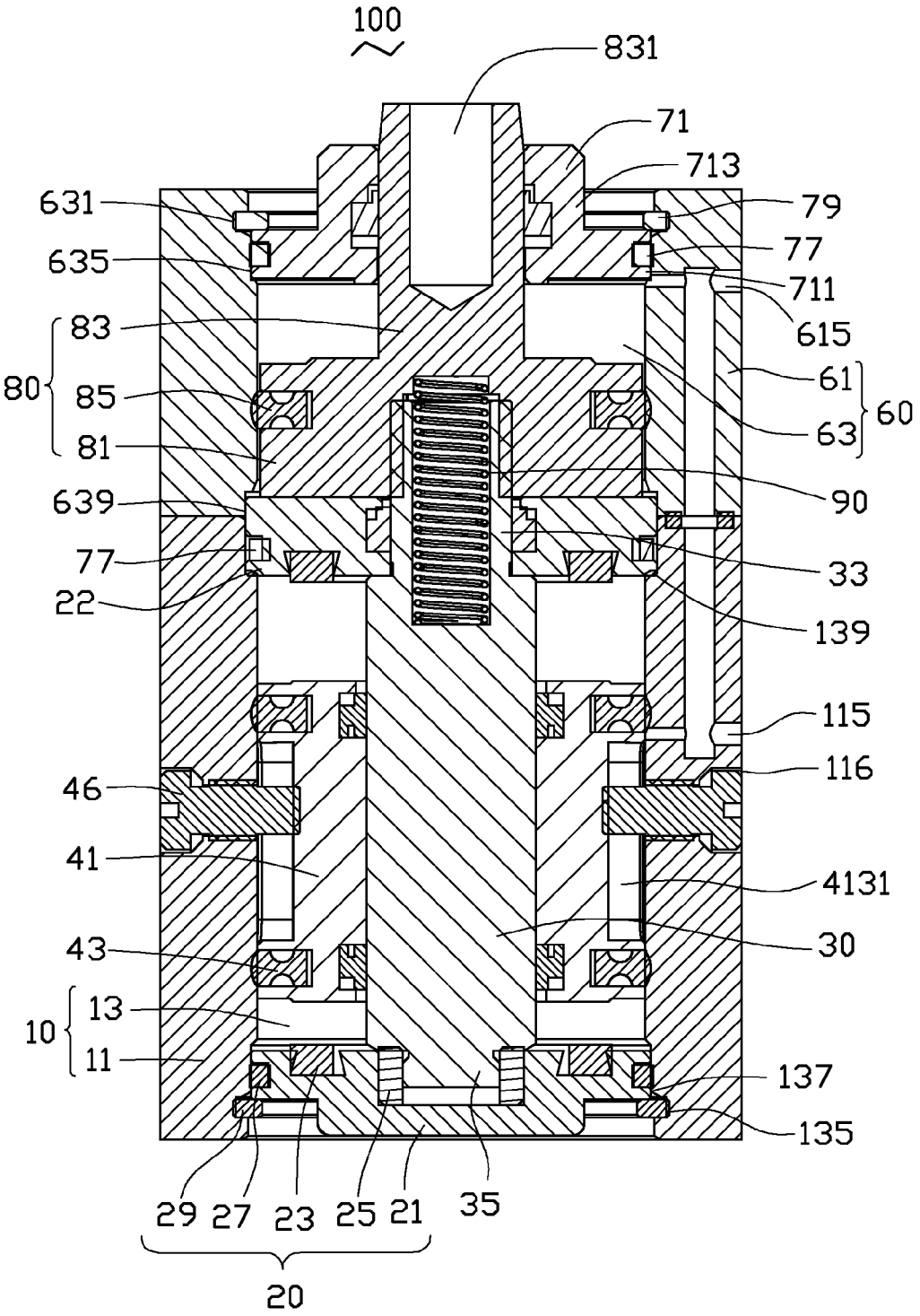
FIG. 5 is a cross section of the rotating air cylinder of FIG. 1, taken along line V-V.

Referring also to FIG. 5, the first cylinder block 10 is a hollow cuboid, including a first cylinder body 11 defining a first chamber 13. The first cylinder body 11 comprises a bottom end 111, a connecting end 112 opposite to the bottom end 111, a side wall 110 connecting the bottom end 111 and the connecting end 112. A first vent 113 and a second vent 114 are formed in the cylinder body 11 respectively adjacent to the bottom end 111 and the connecting end 112. A connecting hole 115 is defined in the middle of the side wall 110. The first vent 113, the second vent 114 and the connecting hole 115 are communicating with the first chamber 13. Two fixing holes 116 are further symmetrically formed in the middle of the first cylinder body 11. A plurality of first mounting holes 117 are defined at the end surface of the connecting end 112 around the first chamber 13. A first retaining groove 135, a second retaining groove 137, and a third retaining groove 139 are defined in the inner wall of the first cylinder body 11. The first and second retaining grooves 135, 137 are adjacent to the bottom end 111, and the second retaining groove 137 is above the first retaining groove 135. The third retaining groove 139 is adjacent to the connecting end 112.

Referring to FIGS. 2 and 3, the first sealing assembly 20 is hermetically positioned in the bottom end 111. The first sealing assembly 20 comprises a bottom cover 21, a buffering block 23, a bearing 25, a first sealing member 27 and a clip ring 29. The bottom cover 21 is retained in the second retaining groove 137. The bottom cover 21 comprises a first resting surface 211, a mounting surface 213 opposite to the first resting surface 211, and a side surface 215 between the first resting surface 211 and the mounting surface 213. A protrusion 2113 protrudes out from the first resting surface 211. A circular resisting groove 2131 is defined at the center of the mounting surface 213. An annular mounting groove 2135 is defined in the mounting surface 213 and surrounds the circular resisting groove 2131. A first sealing groove 2151 is defined in the side surface 215. The ring-shaped buffering block 23 is assembled in the annular mounting groove 2135 for buffering any impact forces on the bottom cover 21. The bearing 25 is received in the circular resisting groove 2131. The first sealing member 27 is mounted in the first sealing groove 2151. The clip ring 29 is positioned in the first retaining groove 135 and holds the bottom cover 21 captive in the first cylinder mechanism 200.

One distal end of the cylinder shaft 30 resists the bottom cover 21 and is partially received in the first cylinder body 11. A distal end of the cylinder shaft 30 extends from the first cylinder body 11 and connects with the second cylinder mechanism 300. The cylinder shaft 30 contains a main body 31, a connecting portion 33, and a resisting portion 35. The connecting portion 33 and the resisting portion 35 extend outward from opposite ends of the main body 31. The main body 31, the connecting portion 33, and the resisting portion 35 are coaxial. Two spiral grooves 315, spiralling around the longitudinal axis of the main body 31, are defined symmetrically in a sidewall 311 of the main body 31. The diameter of the connecting portion 33 is smaller than that of the main body 31. A receiving hole 331 is defined in an end of the connecting portion 33 far away from the main body 31. A plurality of sliding grooves 335 are defined with gaps in a round side surface leaving a plurality of splines surrounding the receiving hole 331.

The first piston assembly 40 movably sleeves on the main body 31 of the cylinder shaft 30. The first piston assembly 40 comprises a first piston 41, two sealing rings 43, a pair of first connecting members 45, and a pair of second connecting members 46. The first piston 41 is a hollow cylindrical structure, including an inner wall 411 and an outer wall 413. Two holding holes 4113 are defined symmetrically in the outer wall 413 extending through the inner wall 411. Two sliding grooves 4131 are symmetrically defined in the outer wall 413 along a longitudinal axis of the first piston 41. Two locking grooves 4135 are defined in the outer wall 413 adjacent to the ends of the first piston 41. The two sealing rings 43 are seated in the two locking grooves so as to prevent gas leakage. Each of the pair of first connecting members 45 is fastened in each of the two holding holes 4113 and in each of the two spiral grooves 315 for connecting the first piston 41 and the cylinder shaft 30 together. Each of the pair of second connecting members 46 is positioned in each of the two fixing holes 116 and each of the two sliding grooves 4131 for connecting the first cylinder block 10 and the first piston 41 together. In the illustrated embodiment, the first and second connecting members 45, 46 are jack screws.

The second cylinder block 60 is a hollow cuboid, which comprises a second cylinder body 61 defining a second chamber 63, and a plurality of fastening members 65. A head end 611 and a tail end 612 are formed at two opposite ends of the second cylinder body 61. A plurality of second mounting holes 613 are defined around the second chamber 63 corresponding to the plurality of first mounting holes 117 in an end surface of the head end 611. A third vent 615 and a fourth vent 617 are formed in the second cylinder body 61 communicating with the second chamber 63. The third vent 615 is interconnected with the connecting hole 115. A first locking groove 631, a second locking groove 635, and a third locking groove 639 are defined in the inner wall of the second cylinder body 61. The first and second locking groove 631, 635 are adjacent to the head end 611, and the first locking groove 631 is above the second locking groove 635. The third locking groove 639 is adjacent to the tail end 612.

The second sealing assembly 70 is positioned in the second cylinder body 61 for sealing the second cylinder mechanism 300. The second sealing assembly 70 comprises a front cover 71, a sealing block 73, a back cover 75, a first sealing ring 77 and a clip ring 79. The front cover 71 is retained in the second locking groove 635. The front cover 71 comprises a circular portion 711 and a holding portion 713 connecting with the circular portion 711. The circular portion 711 comprises a second resting surface 7111, a connecting surface 7113, and a side surface 7115 between the second resting surface 7111 and the connecting surface 7113. The second resting surface 7111 and the connecting surface 7113 are opposite each other. The second resting surface 7111 is far away from the holding portion 713. A trough 7117 is defined at the center of the circular portion 711. The connecting surface 7113 is adjacent to the holding portion 713. A second sealing groove 7119 is defined in the side surface 7115. The holding portion 713 is a hollow structure. The hollow part of the holding portion 713 communicates with the trough 7117. The bore of the hollow part of the holding portion 713 is smaller than that of the trough 7117. The sealing block 73 is ring-typed and is positioned in the trough 7117 for ensuring the air tightness of the front cover 71. The back cover 75 is positioned and is received in the third retaining groove 139 and the third locking groove 639. A shaft hole 751 is defined in the center of the back cover 75. The back cover 75 further comprises a sidewall 753. A third sealing groove 755 is defined in the sidewall 753. The first sealing ring 77 is mounted in the second sealing groove 7119 of the front cover 71. The clip ring 79 is seated in the first locking groove 631 and holds the front over captive in the second cylinder mechanism 300.

The second piston assembly 80 is received in the second cylinder block 60, and is non-rotatably and slidably connected with the cylinder shaft 30. The second piston assembly 80 comprises a second piston 81, a piston shaft 83 connecting with the second piston 81, and a sealing ring 85. The second piston 81 is non-rotatably and slidably connected with the connecting portion 33 of the cylinder shaft 30. A blind hole 813, internally splined to receive and engage the splines of the cylinder shaft 30, is defined in the center of an end of the second piston 81 away from the piston shaft 83. A clamping groove 815 is formed in a side surface of the second piston 81. A receiving opening 831 is defined in an end surface of the piston shaft 83 away from the second piston 81 for receiving a pressing rod (not shown). The sealing ring 85 sleeves on the second piston 81 and engages in the clamping groove 815. In illustrated embodiment, the second piston 81 and the piston shaft 83 are integrally formed. In other embodiments, the second piston 81 and the piston shaft 83 are detachable.

The elastic member 90 is elastically received in the receiving hole 331 and the blind hole 813 of the second piston 81 for helping the second piston assembly 80 to return to an initial position. In the illustrated embodiment, the elastic member 90 is a spring.

Referring to FIGS. 4 to 5, in assembly, the first sealing assembly 20 is assembled in the bottom end 111. The distal end of the cylinder shaft 30 passes through the first piston 41. Each of the pair of first connecting members 45 is fastened in each of the two holding holes 4113 and one of the two spiral grooves 315 for connecting the first piston 41 and the cylinder shaft 30. The first piston assembly 40 and the cylinder shaft 30 are put into the first chamber 13 together. One of the pair of second connecting members 46 is positioned in each of the two fixing holes 116 and each of the two sliding grooves 4131 for connecting the first cylinder block 10 and the first piston 41. The back cover 75 and the first sealing member 27 sleeve on the connecting portion 33. Then the back cover 75 and the first sealing member 27 resist in the third locking groove 139. The elastic member 90 is partially received in the receiving hole 331. The second cylinder block 60 is positioned above the first cylinder block 10. The back cover 75 is also received in the third locking groove 639. Each of the plurality of fastening members 65 passes through each of the plurality of second mounting holes 613 and the first mounting holes 117 for assembling the second cylinder block 60 to the first cylinder block 10. The second piston assembly 80 sleeves on the connecting portion 33 through the blind hole 813. Then the second piston 81 and the cylinder shaft 30 are fixed in co-rotation. The elastic member 90 is elastically received in the receiving room formed by the cylinder shaft 30 and the second piston 81. The front cover 71, the first sealing member 27 and the clip ring 79 sleeve on the piston shaft 83 and are held in the first locking groove 635. A distal end of the pressing rod (not shown) is mounted in the receiving opening 831.

Firstly, the second piston 81 contacts the front cover 71. Gas pressure in the first cylinder mechanism 200 may be increased by means of the second vent 114. A certain pressure of gas will force the first piston 41 towards the bottom end 111 and in being moved down, the cylinder shaft 30, the second piston 81, the piston shaft 83 are driven to rotate around the axis of the rotating air cylinder 100.

Gas pressure is allowed into the second cylinder block 60 via the third vent 615 when the first piston 41 arrives at the bottom end 111. The second piston 81 moves toward the tail end 612 when the gas pressure overcomes the strength of the elastic member 90. The piston shaft 83 moves linearly together with the second piston 81.

Gas pressure is allowed into the first cylinder block 10 by the first vent 113 when the second piston 81 contacts the back cover 75. The second vent 114 allows a decrease in gas pressure from the first chamber 13 and the second chamber 63 at the same time, because the connecting hole 115 is communicating with the third vent 615. The second piston 81, the piston shaft 83 are pushed toward the head end 611 when the gas pressure becomes less than the strength of the elastic member 90. The first piston 41 is forced to move to the connecting end 112 when the gas pressure of the first chamber 13 arrives at a certain preset value. The cylinder shaft 30, the second piston 81, and the piston shaft 83 are driven to rotate back at the same time.

The rotating air cylinder 100 is a simple arrangement of dual cylinders. The cylinder shaft 30, the second piston 81, and the piston shaft 83 are driven to rotate commensurate with the linear motion of the first piston 41. The piston shaft 83 of the rotating air cylinder 100 can rotate and move linearly separately under simple control. The linear movement distance of the pressing rod equaling to a length of each of the plurality of sliding grooves 335 is short. A significant amount of working space will be saved by the rotating air cylinder 100.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A rotating air cylinder, comprising:

a first cylinder mechanism comprising:

a first cylinder block having a first chamber, the first cylinder block further comprising a first vent, a second vent, and a connecting hole defined in a sidewall of the first chamber and communicating with the first chamber, the first vent and the second vent positioned respectively adjacent first and second ends of the first cylinder block, the connecting hole positioned in a middle portion of the first cylinder block;

a first sealing assembly assembled in one distal end of the first cylinder block adjacent to the first vent;

a cylinder shaft partially received in the first chamber;

a first piston assembly received in the first chamber and movably mounted on the cylinder shaft, wherein the first piston assembly comprising a first piston received in the first chamber and movably mounted on the cylinder shaft, the first piston moves longitudinally within the first chamber, and the cylinder shaft configured to be rotated within the first chamber by the first piston;

a second cylinder mechanism positioned coaxial with the first cylinder mechanism and positioned away from the first sealing assembly, the second cylinder mechanism comprising:

a second cylinder block positioned coaxial with the first cylinder block adjacent to the second vent, the second cylinder block having a second chamber, a third vent defined in a sidewall of the second chamber and communicating with the second chamber, another part of the cylinder shaft received in the second chamber;

a second sealing assembly assembled in the second cylinder block, the second sealing assembly comprising a front cover and a back cover, the front cover retained in the second cylinder block away from the first cylinder block, and the back cover assembled within the first cylinder block adjacent to the second vent, the cylinder shaft passing through the back cover; and a second piston assembly received in the second chamber, non-rotatably and slidably connected with the cylinder shaft, wherein the second piston assembly moves longitudinally in the second chamber and rotates relative to an axis of the second cylinder block, the third vent is interconnected with the connecting hole, the rotating air cylinder further comprising an elastic member positioned between the cylinder shaft and the second piston assembly;

wherein gas pressure is allowed into the first cylinder block by the first vent when the second piston assembly contacts the back cover, the second vent allows a decrease in gas pressure from the first chamber and the second chamber at the same time, the second piston is pushed toward the front cover under an elastic force of the elastic member, and the first piston is forced to move towards the back cover when the gas pressure of the first chamber arrives at a certain preset value.

2. The rotating air cylinder of claim 1, wherein the first piston comprises an inner wall and an outer wall, two holding holes are defined symmetrically to an axis of the first piston in the outer wall and extend through the inner wall, two sliding grooves are further defined in the outer wall along a longitudinal axis of the first piston.

3. The rotating air cylinder of claim 2, wherein the first piston further comprises a pair of first connecting members and a pair of second connecting members; two spiral grooves are defined on the cylinder shaft, the two spiral grooves symmetrically spiral around an longitudinal axis of the cylinder shaft; two fixing holes are further formed in the first cylinder block, the two fixing holes are symmetrical to each other about an axis of the first cylinder block; the first piston and the cylinder shaft are connected by each of the pair of first connecting members fastened to each of the two holding holes and each of the two spiral grooves; and the first cylinder block and the first piston are connected by each of the pair of the second connecting members inserted into each of the two fixing holes and each of the two sliding grooves.

4. The rotating air cylinder of claim 1, wherein a distal end of the cylinder shaft comprises a plurality of sliding grooves intercepted with a gap between each of the plurality of sliding grooves, wherein each of the plurality of sliding grooves and the gap form a spline; and the second piston assembly comprises a blind hole, wherein the blind hole is shaped to internally receive and engage each spline of the cylinder shaft, the elastic member is received in the blind hole.

5. The rotating air cylinder of claim 4, wherein the second piston assembly comprises a second piston, and a piston shaft connected with the second piston, the second piston and the piston shaft are received in the second chamber, the second piston is positioned adjacent to the back cover, the piston shaft passes through the front cover, and the blind hole is defined in one end surface of the second piston adjacent to the back cover.

6. The rotating air cylinder of claim 5, wherein a receiving opening is defined in an end surface of the piston shaft, away from the second piston.

7. The rotating air cylinder of claim 1, wherein the first sealing assembly comprises a bottom cover positioned in a bottom of the first cylinder block, the bottom cover comprise a resting surface and a mounting surface opposite to the resting surface; a circular resisting groove is defined in a center of the mounting surface, one end portion of the cylinder shaft resists a sidewall of the circular resisting groove away from the second cylinder block.

* * * * *